US010320120B2

(12) United States Patent
Roure Pastor et al.

(10) Patent No.: US 10,320,120 B2
(45) Date of Patent: Jun. 11, 2019

(54) FASTENER DEVICES TO SECURE CONNECTIONS

(71) Applicant: HEWLETT-PACKARD DEVELOPMENT COMPANY, L.P., Houston, TX (US)

(72) Inventors: Francesc Roure Pastor, Barcelona (ES); Santiago Forcada, Sant Cugat del Valles (ES); David Soriano, Terrassa (ES); David Sala Porta, Barcelona (ES); Xavier Gomez Travesset, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/546,101

(22) PCT Filed: Apr. 17, 2015

(86) PCT No.: PCT/EP2015/058454
§ 371 (c)(1),
(2) Date: Jul. 25, 2017

(87) PCT Pub. No.: WO2016/165784
PCT Pub. Date: Oct. 20, 2016

(65) Prior Publication Data

US 2018/0026398 A1 Jan. 25, 2018

(51) Int. Cl.

| | |
|---|---|
| ***H01R 13/639*** | (2006.01) |
| ***H01R 43/26*** | (2006.01) |
| *H01R 13/518* | (2006.01) |

(52) U.S. Cl.
CPC ..... *H01R 13/639* (2013.01); *H01R 13/6392* (2013.01); *H01R 43/26* (2013.01); *H01R 13/518* (2013.01)

(58) Field of Classification Search
None
See application file for complete search history.

(56) References Cited

U.S. PATENT DOCUMENTS

| | | | | |
|---|---|---|---|---|
| 3,475,716 A * | 10/1969 | Laig | ..... | H01R 13/6392 24/16 PB |
| 4,097,105 A * | 6/1978 | Zumwalt | ..... | H01R 13/6392 439/369 |
| 4,183,603 A | 1/1980 | Donarumme | | |

(Continued)

FOREIGN PATENT DOCUMENTS

| | | |
|---|---|---|
| CN | 101151773 | 3/2008 |
| CN | 103988374 | 8/2014 |
| CN | 104518333 | 4/2015 |

OTHER PUBLICATIONS

Han® PCB adapters with cable to board connection—Harting USA.

*Primary Examiner* — Tho D Ta
(74) *Attorney, Agent, or Firm* — HP Inc. Patent Department

(57) ABSTRACT

There is provided a fastener device and methods of using a fastener device, the device comprising a body having a first end comprising a supporting portion adapted to support at least a rear surface of a connector plug and a second opposite end comprising a latching portion adapted to engage at least a rear surface of a socket when the connector plug is inserted into the socket.

8 Claims, 4 Drawing Sheets

(56) References Cited

U.S. PATENT DOCUMENTS

| | | | | | |
|---|---|---|---|---|---|
| 4,607,903 | A * | 8/1986 | Hoshino | H01R 13/6271 | 439/350 |
| 4,664,463 | A | 5/1987 | Carmo | | |
| 5,393,243 | A * | 2/1995 | Carmo | H01R 13/6392 | 439/369 |
| 5,573,420 | A * | 11/1996 | Grosswendt | H01R 13/6392 | 24/16 PB |
| 5,876,234 | A | 3/1999 | Hester | | |
| 6,080,004 | A * | 6/2000 | Kovacik | H01R 13/6392 | 439/352 |
| 6,319,044 | B1 * | 11/2001 | Stekelenburg | H01R 13/6392 | 439/369 |
| 6,851,964 | B2 * | 2/2005 | Miller | H01R 23/667 | 439/372 |
| 6,997,734 | B1 | 2/2006 | McQuirter | | |
| 7,524,205 | B1 * | 4/2009 | Lee | H01R 13/6392 | 439/350 |
| 7,749,015 | B2 | 7/2010 | Uchikawa et al. | | |
| 7,874,864 | B2 | 1/2011 | Luu | | |
| 7,914,316 | B2 | 3/2011 | D'Addario et al. | | |
| 8,206,173 | B2 * | 6/2012 | Won | H01R 12/78 | 439/372 |
| 8,298,922 | B2 | 10/2012 | Schumann et al. | | |
| 9,431,778 | B1 * | 8/2016 | Mueller | H01R 13/447 | |
| 2014/0038449 | A1 | 2/2014 | Fallon et al. | | |
| 2014/0302694 | A1 * | 10/2014 | Qiao | H01R 13/6272 | 439/78 |
| 2015/0093932 | A1 | 4/2015 | Ning et al. | | |

* cited by examiner

FASTENER DEVICES TO SECURE CONNECTIONS

BACKGROUND

Modern electronic devices, such as computers, printers, etc. generally include large numbers of electrical connections. Commonly, such connections may be provided using a plug and socket where a cable is terminated in a plug that can be inserted in a socket to provide the electrical connection.

Plug and socket connections provide an easy and normally reliable method of providing internal connections between sub-components of a larger device. In particular, the ability to unplug and then reconnect connections may simplify maintenance by allowing a particular sub-component to be easily swapped.

BRIEF INTRODUCTION OF THE DRAWINGS

Examples of the present invention are further described hereinafter by way of example only with reference to the accompanying drawings, in which.

Figure 6:
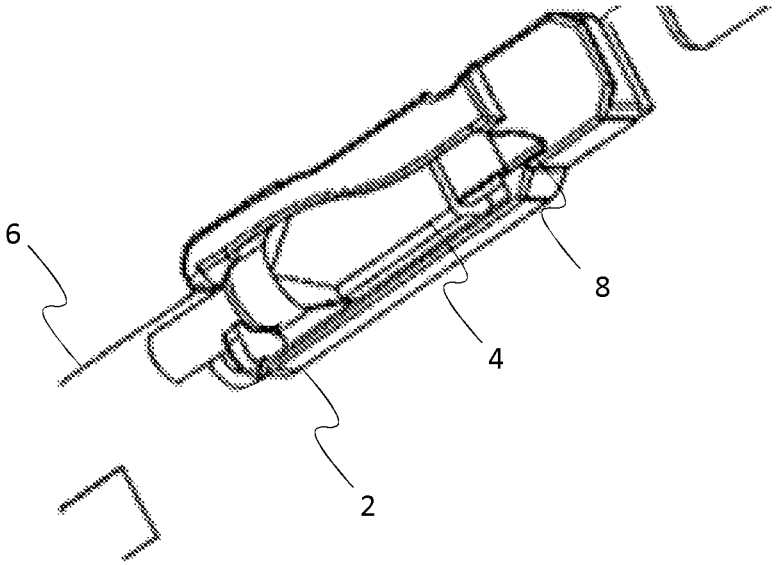
Figure 7:
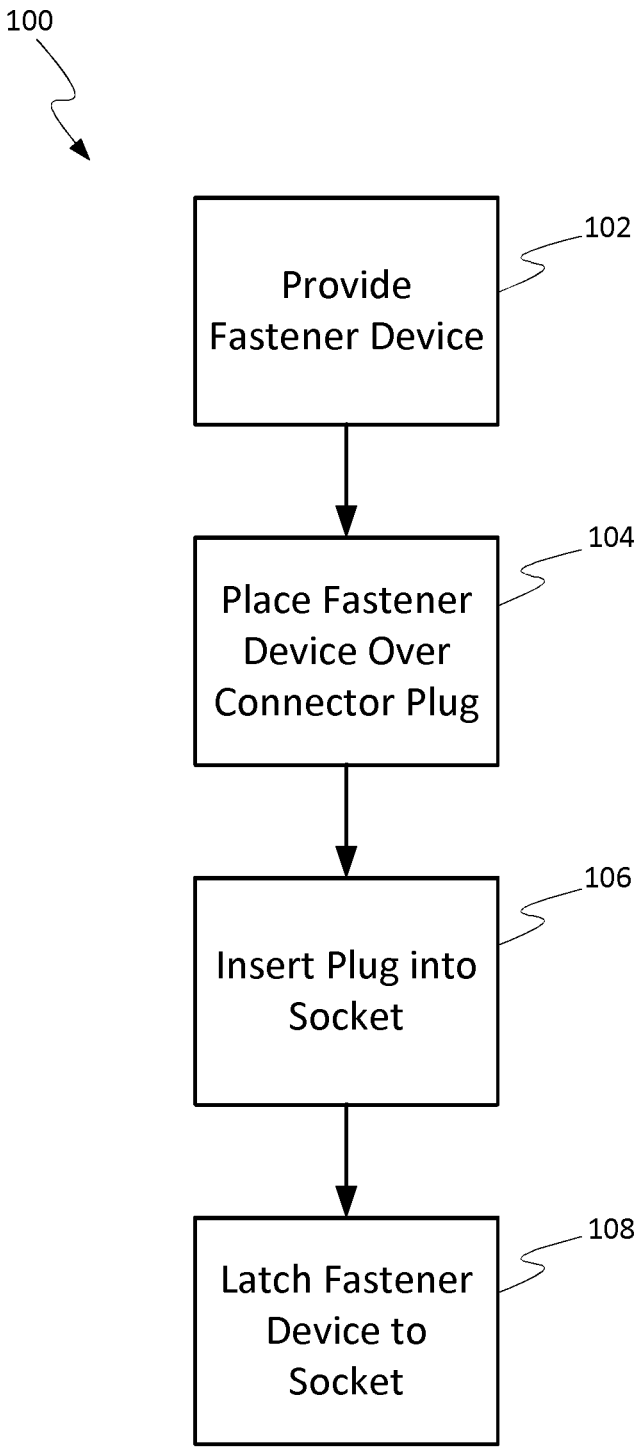

FIG. 6 provides an isometric cutaway view of the device in the snapped position; and FIG. 7 illustrates a method of using the fastener device.

DETAILED DESCRIPTION OF AN EXAMPLE

Ensuring a reliable connection between a cable plug and its socket can have a significant effect on the operation and reliability of electronic apparatus such as, for example, a printing system. In some circumstances, it has been observed that a loose, or incomplete, connection may be caused by human error during assembly or due to transport vibration and such failed connections may cause a permanent or intermittent failure to be exhibited in the electronic apparatus.

For example, failed connections have been noted to cause printer shutdowns, image quality issues or to cause assorted system errors to be presented to the final user. Standard cable plug connections rely on the experience of the manufacturing operator to ensure a good connection: there is no mechanical feedback for a satisfactory connection. This may be sufficient to provide a connection in many cases, but may also cause many undetected or hard-to-detect fail conditions. These fail connections are often detected on a final assembly stage, where troubleshooting is much more expensive.

Standard plug-socket connections rely on the friction between both components. While this friction is sufficient to maintain contact in initial assembly conditions, it may decrease significantly due to transport conditions (vibrations and ambient conditions) or apparatus usage. Furthermore, high number of plug-in cycles will reduce this friction and the reliability of the connection.

A common issue that has been noted is the accidental disconnection of a cable plug when repairing a neighbouring cable, and this may cause unnecessary repair visits to fix problems caused by a previous repair visit and impact negatively on customer satisfaction.

Some approaches to plug and socket connections in electronic devices include: relying on the friction between cable plug and socket has a high risk of wrong connection or easy disconnection along time; use of a complex snap socket which increases the cost of all the cables, even if the snap is unnecessary for some of the connections and also tends to increase the circuit board real estate used for the connection; and using a permanent fix (screw or similar) to force the correct connection that needs to be removed every time the cable is unplugged and has a high risk of not fixing it back again.

Figure 1:
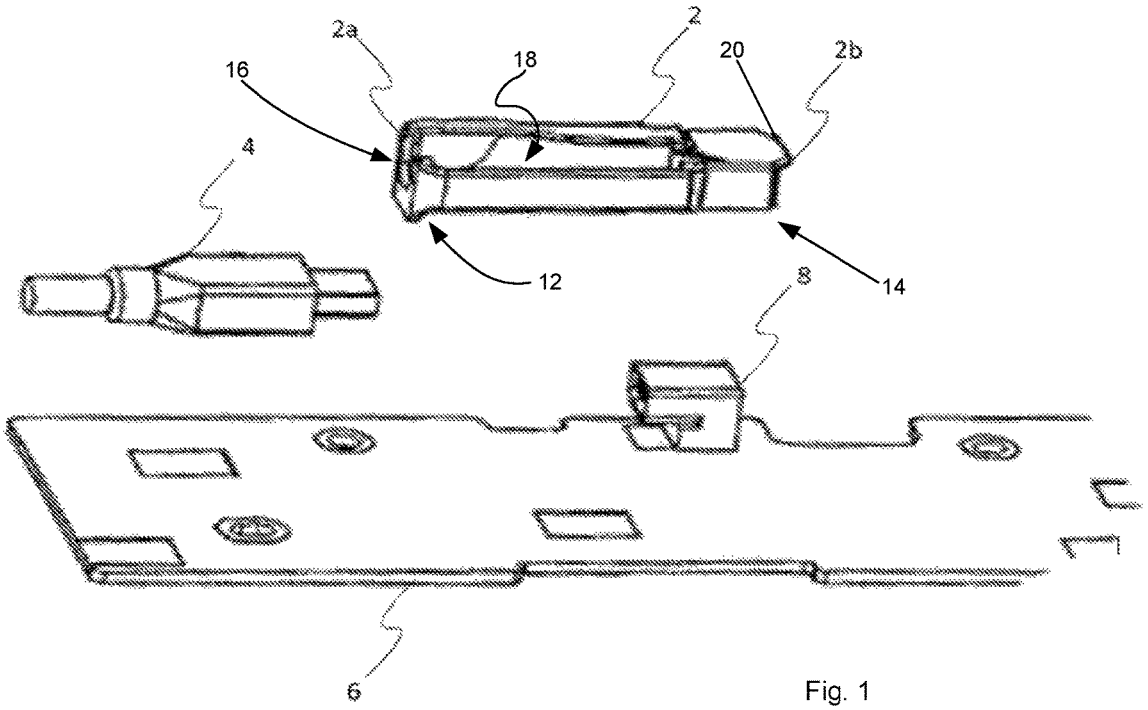
FIG. 1 is a cutaway view of a fastener device according to some examples.

FIG. 1 illustrates a typical cable connector plug 4 which is to be coupled to a circuit board 6 via a socket 8 mounted on the circuit board that may be present in an electronic apparatus such as a printing device. FIG. 1 further includes a fastener device 2 which can be used to ensure both correct insertion of the plug into the socket.

The connector fastener device 2 comprises a single body having a first end 2*a* comprising a supporting portion 12 adapted to support a rear surface of the connector plug 4. A second opposite end 2*b* of the connector fastener device body comprises a latching portion 14 that is adapted to be pressed over the socket 8 when the connector plug 4 is inserted into the socket. Once 'snapped' into position over the socket, the latching portion 14 engages with a rear surface of the socket 8, thereby holding the plug 4 firmly in place.

In the case that the plug 4 is not correctly inserted into the socket 8, it will be difficult or impossible to correctly 'snap' the device 2 into place over the socket 8. Thus, use of the device 2 ensures that the plug 4 is correctly inserted into the socket 8, and provides a clear feedback to the operator if a correct insertion has not been achieved.

Furthermore, once the device has been snapped into position over the socket 8, the plug 4 and socket 8 are held in the connected position such that the possibility of accidental disconnection or failure of the connection due to vibration, etc. is significantly reduced.

Figure 2:
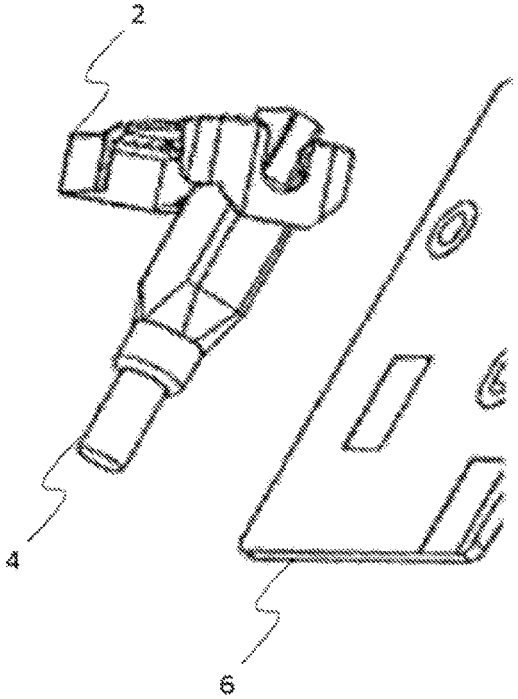
FIG. 2 illustrates attachment of the fastener device of FIG. 1 to a cable plug.
Figure 3:
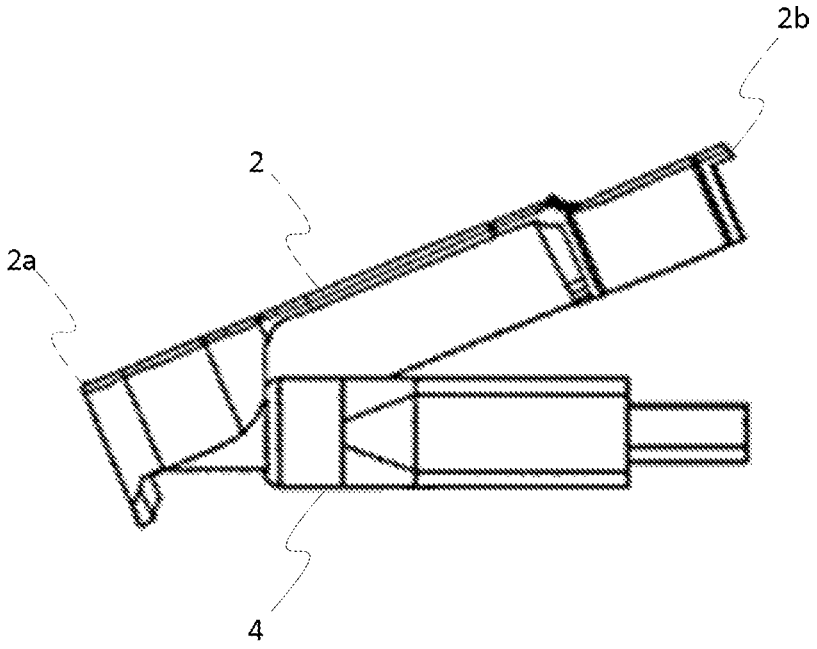
FIG. 3 illustrates alignment of the fastener device of FIG. 1 for insertion of a cable plug in a socket.

FIG. 2 illustrates applying the fastener device 2 to a connector plug 4. As shown in FIG. 2, the plug 4 is passed through an aperture 16 in the device 2. The first end 2*a* of the device 2 is then located over the rear of the plug 4, as illustrated in FIG. 3. As shown in FIG. 3, the second end 2*b* of the fastener device 2 is positioned clear of the cable plug to allow insertion into the socket 8.

Figure 4:
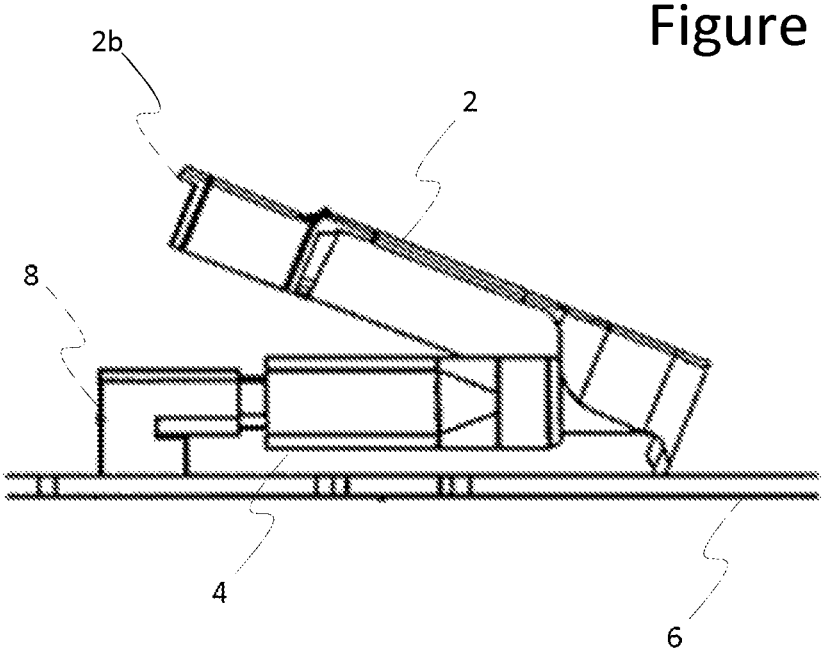
FIG. 4 illustrates insertion of a cable plug attached to the fastener device of FIG. 1 in a socket.

FIG. 4 illustrates insertion of the plug 4 into the socket 8 with the device 2 in place. Once the plug is inserted, the second end 2*b* of the fastener device 2 is pressed over the socket 8 and snaps into position.

Figure 5:
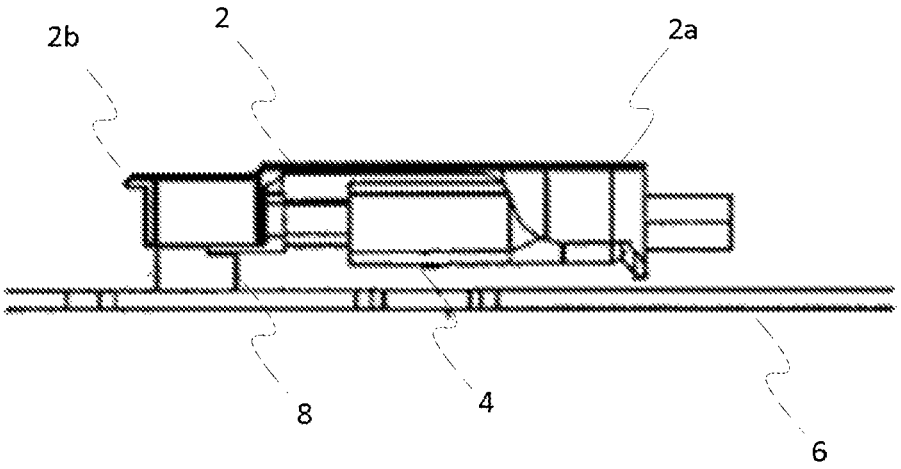
FIG. 5 illustrates the fastener device in the snapped position.

FIG. 5 illustrates the fastener device in the snapped position. As can be seen in FIG. 5, once correctly engaged with the rear of the socket 8, the device provides a retaining force between the socket and the rear of the plug 4, ensuring that the plug 4 cannot easily be disengaged from the socket 8.

According to some examples, the second end 2*b* of the fastener device 2 may be provided with a lip 20 to facilitate easier disengagement of the fastener device 2 when it is desired to disconnect the plug and socket. According to some examples, a channel 18 may be provided in the first end 2*a* of the fastener device 2 through which a cable attached to the connector plug 4 can pass.

In the above description, an aperture in the body of the fastener device 2 was described to allow the connector plug 4 to pass through the fastener device. In other examples, the body of the fastener device 2 may comprise a half-cage, or similar design that obviates the need for an aperture.

The fastener device 2 may be fabricated in any suitable material, for example the device 2 could be a simple, and low cost, molded plastic part. Furthermore, the fastener device 2 may only be installed on specific connections as desired, and can easily be retrofitted to legacy device connections, such as a plug-socket connection that has experienced a large number of insertion cycles and has become unreliable.

The fastener device 2 is easy to install and provides a clear indication of an incorrectly inserted plug, as it will not be possible to correctly snap the device over the socket if the plug is not correctly inserted. The possibility of accidental disconnection of a plug-socket is significantly reduced as the force needed to disengage a connection with a fastener device 2 in place is significantly increased. Furthermore, the use of a fastener device on a connection has negligible impact on the circuit board space needed to provide the connection.

Thus, the described fastener device 2 provides a simple plastic part design that helps avoid connection issues without adding excessive cost or complexity to a standard cable connection.

FIG. 6 provides an isometric view of the fastener device 2 in the closed, or snapped, position. The relative positions of the connector plug 4, fastener device 2 and socket 8 mounted on the circuit board 6 can be clearly seen.

FIG. 7 illustrates a method 100 of using the fastener device 2 to secure a plug and socket connection. According to the method 100 of FIG. 7, a provided 102 fastener device 2 is placed 104 over a connector plug 4 of a connection that is to be secured. The connector plug 4 is then inserted 106 into a socket 8. Once the connector plug 4 is correctly inserted into the socket 8, a downward force is applied to the fastener device 2 over the socket 8 to latch 108 the fastener device 2 in the closed position over the socket.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A connector system comprising:

a connector plug;

a socket mounted on a circuit board; and a fastener device comprising:

a body having a first end comprising a supporting portion adapted to support at least a rear surface of the connector plug above the circuit board to align the connector plug with the socket and a second opposite end comprising a latching portion adapted to engage at least a rear surface of the socket after the connector plug is inserted into the socket, wherein the body further comprises an aperture to allow a cable attached to the connector plug to be inserted through the body of the fastener device.

2. The connector system of claim 1, wherein the supporting portion includes a cable channel for a cable connected to the connector plug.

3. The connector system of claim 1, wherein the latching portion further comprises a lip.

4. The connector system of claim 1, wherein the fastener device is plastic.

5. The connector system of claim 1, wherein the latching portion is arranged to be disengaged when lifted from the socket.

6. The connector system of claim 1, wherein the latching portion is further adapted not to engage the at least a rear surface of the socket when the connector plug is not correctly inserted into the socket.

7. The connector system of claim 1, wherein the latching portion is further adapted to engage the at least a rear surface of a socket when the connector plug is inserted into the socket when a downward force is applied to the latching portion.

8. The connector system of claim 1, wherein the body is a unitary piece of molded plastic.

* * * * *